United States Patent [19]

Kunimoto

[11] Patent Number: 4,815,354

[45] Date of Patent: Mar. 28, 1989

[54] TONE SIGNAL GENERATING APPARATUS HAVING A LOW-PASS FILTER FOR INTERPOLATING WAVEFORMS

[75] Inventor: Toshifumi Kunimoto, Hamamatsu, Japan

[73] Assignee: Nippon Gakki Seizo Kabushiki Kaisha, Shizuoka, Japan

[21] Appl. No.: 792,496

[22] Filed: Oct. 29, 1985

[30] Foreign Application Priority Data

Oct. 30, 1984 [JP] Japan ..... 59-228371

[51] Int. Cl.[4] ..... G10H 1/12; G10H 1/46

[52] U.S. Cl. ..... 84/1.19; 84/DIG. 9; 84/DIG. 10; 364/723; 364/724.1

[58] Field of Search ..... 84/1.01, 1.03, DIG. 10, 84/1.04, 1.11, 1.12, 1.19, 1.21, DIG. 9; 364/724, 718, 721, 723

[56] References Cited

U.S. PATENT DOCUMENTS

| | | | |
|---|---|---|---|
| 4,138,915 | 2/1979 | Nagai et al. | 84/1.22 |
| 4,175,463 | 11/1979 | Deutsch | 84/1.19 |
| 4,185,529 | 1/1980 | Kitagawa | 84/1.01 |
| 4,267,761 | 5/1981 | Deutsch | 84/1.01 |
| 4,348,929 | 9/1982 | Gallitzendörfer | 84/1.01 |
| 4,548,119 | 10/1985 | Wachi et al. | 84/1.19 |
| 4,641,564 | 2/1987 | Okamoto | 84/DIG. 9 |
| 4,679,480 | 7/1987 | Suzuki | 84/DIG. 9 |

FOREIGN PATENT DOCUMENTS 2103005 2/1983 United Kingdom .

*Primary Examiner*—Stanley J. Witkowski

*Attorney, Agent, or Firm*—Spensley, Horn, Jubas & Lubitz

[57] ABSTRACT

A tone signal generating apparatus comprises a waveform memory in which a plurality of waveform data representing different waveforms but corresponding to a same tone name are stored. These different waveform data are sequentially read from the memory and are supplied to a digital low-pass filter which comprises a delay circuit and a multiplier connected to each other to form a feedback loop. The low-pass filter smoothes abrupt variation of the waveform data and outputs a smoothed waveform data thereby interpolating the different waveforms. A tone signal is produced in accordance with this smoothed waveform data.

9 Claims, 4 Drawing Sheets

TONE SIGNAL GENERATING APPARATUS HAVING A LOW-PASS FILTER FOR INTERPOLATING WAVEFORMS

BACKGROUND OF THE INVENTION

Field of the Invention

This invention relates to a tone signal generating apparatus suitable for use in an electronic musical instrument.

There have been proposed various kinds of tone signal generating apparatuses in which tone signals are electronically produced. Among such tone signal generating apparatuses, there is known one in which a musical tone signal is formed by repeatedly and sequentially reading from a memory each of a plurality of groups of data representing preselected portions of the musical tone signal. In such conventional tone signal generating apparatus, when the tone signal S to be generated has an envelope L as shown in FIG. 1, sampling data (or waveform data) of portions A1, A2, . . . of the tone signal S are previously stored in a memory. In this case, time length of each of the portions A1, A2, . . . is set to one period of the tone signal S. And, during the time T1 shown in FIG. 1, the sample data of the portion A1 of the tone signal S are sequentially and repeatedly read from the memory to generate the tone signal S. In the same manner, during the time T2 the sample data of the portion A2 are sequentially and repeatedly read from the memory to generate the tone signal S, during the time T3 the sample data of the portion A3 are read from the memory, and so on.

The above-described musical tone generating apparatus however has such a deficiency that a complicated signal processing need be performed at each of the boundary portions between the time T1 and the time T2, between the time T2 and the time T3, and so on. More specifically, for example, if the tone signal based only on the sample data of the portion A3 begins to be generated immediately after the completion of the generation of the tone signal corresponding to the time T2, the waveform of the tone signal abruptly varies at the boundary between the time T2 and the time T3. As a result, the generated musical tone becomes somewhat odd. To solve this problem, an interpolation structure has been proposed in the U.S. patent application No. 690,771 filed on Jan. 9, 1985 under the title "Tone Signal Generation Device For An Electronic Musical Instrument" and now U.S. Pat. No. 4,633,749 invented by different inventors from but assigned to the same assignee with the present application. This U.S. Ser. No. 690,771 is not prior art of the present application but referred to here by way of explanation of the advantages of the present application, and in that application, the sample data precedingly read from the memory and the sample data currently read from the memory are multiplied respectively by data decreasing from "1" to "0" with the lapse of time and data increasing from "0" to "1" with the lapse of time, as shown in FIG. 2. And, the thus obtained multiplication results are added together to form the tone signal in which the abrupt variation or discontinuity of the waveform has been compensated. This arrangement is however disadvantageous in that the construction of the circuit necessary for compensating for the abrupt variation of the waveform is rather complicated.

SUMMARY OF THE INVENTION

It is therefore an object of the present invention to provide a tone signal generating apparatus which can generate, with a simplified structure, a musical tone signal close to that generated by a natural musical instrument by sequentially generating waveform data representative of a plurality of portions of an overall waveform of the tone signal.

It is another object of the present invention to provide a tone generating apparatus having a simple structure to interpolate the succeeding waveforms in a tone signal.

According to an aspect of the invention, there is provided a tone signal generating apparatus comprising waveform data generating means for generating data relating to at least first and second periodic waveforms of a tone signal, the waveform data generating means sequentially generating data representative of the first waveform and data representative of the second waveform; and low-pass filter means for filtering the data generated by the waveform generating means to output a filtered data as the tone signal, the low-pass filter means comprising delay circuit means for delaying data supplied thereto by a time interval determined in accordance with the periods of the first and second waveforms to output a delayed data, and feedback circuit means for feeding the delayed data back to the delay circuit means, the feedback means multiplying the delayed data by a predetermined filter coefficient and feeding the resultant data to the delay circuit means as the feedback data, the data generated by the waveform data generating means being supplied to the fedback delay circuit means.

DESCRIPTION OF THE PREFERRED EMBODIMENT OF THE INVENTION

Figure 3:
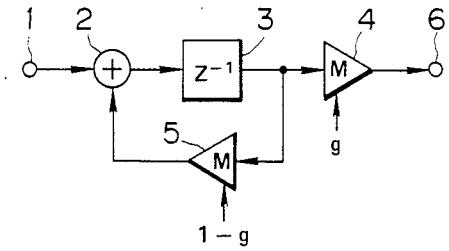
FIG. 3 is a block diagram of an ordinary digital low-pass filter.
Figure 4:
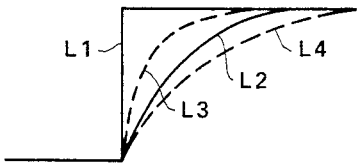
FIG. 4 is an illustration showing the characteristic of the low-pass filter of FIG. 3.

FIG. 3 shows the construction of a low-pass filter which is known perse and comprises an input terminal 1 for receiving data to be filtered, an adder 2, a delay circuit 3 such as a D-type flip-flop (DFF) for delaying an output data of the adder 2 by a time interval equal to one sampling time of the input data. This digital low-pass filter further comprises a multiplier 4 for multiplying data fed from the delay circuit 3 by a filter coefficient g, another multiplier 5 for multiplying the data fed from the delay circuit 3 by a feedback coefficient (1−g) and an output terminal 6 for taking out an output of this filter from the multiplier 4. With this digital low-pass filter, when the input data supplied to the input terminal 1 abruptly varies as indicated by a solid line L1 in FIG. 4, the output data at the output terminal 6 gradually varies along an exponential curve as indicated by a solid line L2 in the same figure. The form of the curved line L2 can be altered by changing the value of the coefficient g as indicated by broken lines L3 and L4 in FIG. 4. The coefficient g is normally set to a value slightly less than "1".

Figure 5:
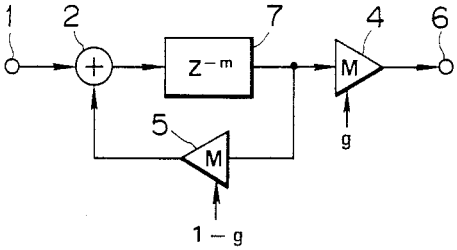
FIG. 5 is a block diagram of a modified form of the low-pass filter of FIG. 3 wherein the delay circuit 3 is replaced by a delay circuit 7.

FIG. 5 shows another digital low-pass filter which differs from that shown in FIG. 3 in that the delay circuit 3 is replaced by a delay circuit 7 which delays an input thereto by a time interval equal to m sampling times of the data fed to the input terminal 1. The delay circuit 7 may comprise serially connected m DFFs. The filter shown in FIG. 5 acts, as a low-pass filter, on those sample data produced every m sampling times. In other words, the low-pass filter shown in FIG. 5 processes m sample data contained in each group of data individually in a time sharing manner.

Figure 6:
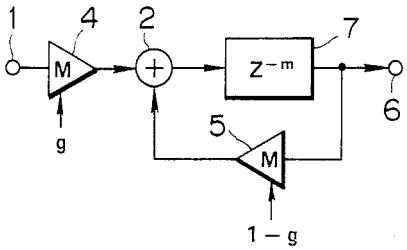
FIG. 6 is a block diagram of a modified form of the low-pass filter of FIG. 5.
Figure 7:
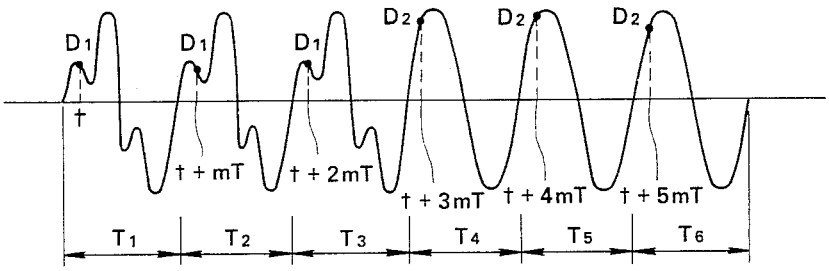
FIG. 7 is an illustration showing one example of waveform of a musical tone.
Figure 8:
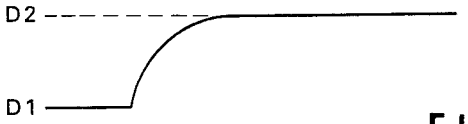
FIG. 8 is an illustration showing the characteristic of the low-pass filter of FIG. 6.

FIG. 6 shows a modified form of the low-pass filter of FIG. 5 which differs therefrom in the position of the multiplier 4. This modified low-pass filter shown in FIG. 6 is substantially the same in function as that shown in FIG. 5 but is superior thereto in that the variation of level of data at the output terminal 6 at the time when the filter coefficient g is changed is smaller than that in the filter of FIG. 5 And, a low-pass filter 28 provided in an embodiment of the invention (FIG. 10), which will be described later, is formed on the basis of the low-pass filter of FIG. 6. The operation of the low-pass filter of FIG. 6 performed when data representative of a musical tone waveform (or sample data of a musical tone signal) are applied will be described. FIG. 7 shows one example of waveform of a musical tone, wherein the waveforms of the musical tone in time periods T1, T2 and T3 are identical to each other. And, the waveforms of the musical tone in time periods T4, T5 and T6 are also identical to each other, but the waveform in each of the time periods T1, T2 and T3 differs from that in each of the time periods T3, T4 and T5. The time periods T1 to T6 are of the same time length, and a sampling of the waveform is made m times during each time period. Assuming that a sample data D1 is applied to the input terminal 1 of the filter of FIG. 6 at time t shown in FIG. 7, data identical to the data D1 are applied to the input terminal 1 at times t+mT (T is a sampling time) and t+2mT, respectively, and sample data D2 are applied to the input terminal 1 at times t+3mT, t+4mT and t+5mT, respectively. In this case, since the low-pass filter of FIG. . 6 acts on those sample data produced every m sampling times, as described before, the data sequentially outputted from the output terminal 6 at the times t+mT, t+2mT, . . . gradually varies from the value D1 to the value D2 along an exponetial curve as shown in FIG. 8. Output data corresponding to those other than the above sample data vary in the same manner. Thus, when data representative of a musical tone waveform which abruptly varies as shown in FIG. 7 are applied to the input terminal 1, data representative of a musical tone waveform whose abrupt variation has been compensated are outputted from the output terminal 6. It will be appreciated that the output data of the filter of FIG. 6 can alternatively be taken from the output of the adder 2 instead of output terminal 6. The difference between the two output data exists only in that the output data taken from the output of the adder 2 is shifted from that taken from the output terminal 6 by a time interval equal to mT.

Figure 9:
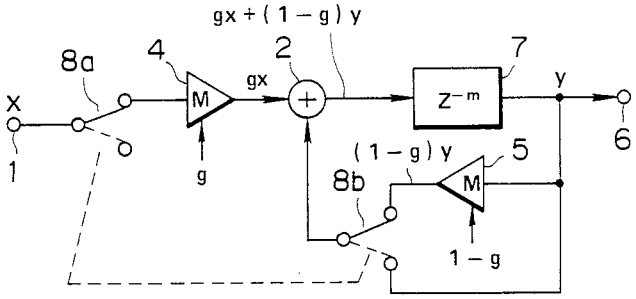
FIG. 9 is a block diagram of a low-pass filter equivalent to that applicable to the present invention.

FIG. 9 shows a modified form of the low-pass filter of FIG. 6 which differs therefrom in that interlocked switches 8*a* and 8*b* are provided. When both of the switches 8*a* and 8*b* are in the solid line positions, this low-pass filter is equivalent to the low-pass filter of FIG. 6. On the other hand, when the switches 8*a* and 8*b* are in the broken line positions, output data of the delay circuit 7 are supplied through the switch 8*b* and the adder 2 to the input terminal of the same delay circuit 7 thereby to self-hold the data contained therein. With this arrangement, the compensation for the abrupt variation of the waveform of a musical tone can be performed more gradually by holding the switches 8a and 8b in the solid line positions for a time interval corresponding to one period (or cycle) of the waveform, subsequently holding the switches 8*a* and 8*b* in the broken line positions for a time interval corresponding to, for example, five periods of the waveform, and thereafter repeating the above two operations.

The embodiment of the present invention will now be described with reference to FIGS. 10 and 11, wherein a circuit equivalent to the circuit shown in FIG. 9 is used as the lowpass filter 28.

Figure 1:
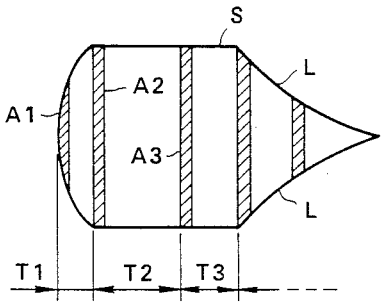
FIG. 1 is an illustration showing one example of waveform of a musical tone.
Figure 2:
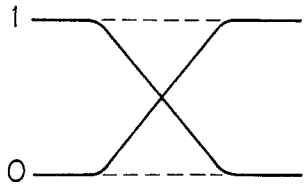
FIG. 2 is an illustration showing one method of compensating for an abrupt variation or discontinuity of waveform.

With this embodiment, data representative of the portions A1, A2, . . . of the waveform of the musical tone signal shown in FIG. 1 are previously stored in a waveform memory 14, and the musical tone signal is generated by reading the data from the memory 14. The musical tone generating apparatus shown in FIG. 10 comprises a keyboard 11 and a key depression detection circuit 12. The key depression detection circuit 12 detects a state of each key of the keyboard 11, outputs a key code KC representative of a depressed key in accordance with the detection results, and outputs a key-on signal KON which rises to "1" at the beginning of the depression of the key and falls to "0" at the end of the depression of the key. The key code KC and the key-on signal KON are fed to an address generator 13 which generates address data to be supplied to the waveform memory 14 and a coefficient memory 15. As shown in FIG. 11, the address generator 13 comprises a note clock generator 16 which generates a note clock $\phi$ of a frequency corresponding to the key designated by the key code KC. A differentiator 17 outputs a key-on pulse KONP of a short pulse width at the leading edge of the key-on signal KON, that is to say, when a key begins to depressed. A counter 18 having a count range of "m" counts up the note clock $\phi$ and is reset by the key-on pulse KONP. A count output of the counter 18 varies within the range of "0" to "m−1" and is supplied to the waveform memory 14 as address data AD1. The counter 18 also outputs a carry signal CA to a counter 19 when the count output of the counter 18 changes from "−1" to "0". The counter 19 counts up the carry signal CA and is reset by an output of an OR gate 20. A repetition number memory 21 previously stores data representative of the number of repetitions of the same waveform, that is to say, data representative of the number of repetitions of each of the waveforms of the portions A1, A2, A3, . . . shown in FIG. 1. A comparator 22 compares a count output of the counter 19 with an output data of the repetition number memory 21 and outputs to one input terminal of an AND gate 24 a coincidence signal EQ of "1" when the both outputs coincide to each other. A counter 23 counts up the coincidence signal EQ fed from the comparator 22 through the AND gate 24 and is reset by the key-on pulse KONP. A NAND gate 25 effects a NAND operation on all the bits of a count output of the counter 23 and outputs the result of the NAND operation to the other input terminal of the AND gate 24. A switch control circuit 26 generates in accordance with the count output of the counter 19 a switch control signal SON for controlling the ON/OFF state of a switch 30 in the low-pass filter 28 shown in FIG. 10. This switch control circuit 26 renders the switch control signal SON "1" when the count output of the counter 19 is, for example, any one of "0", "5", "10""15", . . . , and renders the switch control signal SON "0" when the count output of the counter 19 takes any other values. When the switch control signal SON is in the state of "1", the switch 30 is brought into the ON state.

The waveform memory 14 has therein storage areas E0, E1, E2, . . . for respectively storing data representative of the portions A1, A2, A3, . . . of the waveform shown in FIG. 1. In this case, each of the portions A1, A2, A3, . . . constitutes one period or one cycle of the waveform and is represented by m sample data, so that m sample data are stored in each of the storage areas E0, E1, E2, . . . One of the storage areas E0, E1, E2, . . . is designated by address data AD1 fed from the counter 23, and the sample data in the designated storage area are read therefrom in accordance with address data AD1 fed from the counter 18. The sample data read from the waveform memory 14 are supplied to the low-pass filter 28 which comprises a subtractor 29, the switch 30, a multiplier 31, an adder 32 and a delay circuit 33. In this case, the multiplier 31 may be constituted by the combination of a data shift circuit and an adder. The delay circuit 33 is for delaying data inputted thereto by m bit-times of the note clock $\phi$ and comprises m stages of DFFs, each stage of which is triggered by the note clock $\phi$ and reset by the key-on pulse KONP. This low-pass filter 28 is equivalent to the low-pass filter shown in FIG. 9, as will be appreciated from the following description. Assuming that the data at the input terminal 1 and the output data of the delay circuit 7 in FIG. 9 are expressed as x and y, respectively, the outputs of the multipliers 4 and 5 are expressed as $g \cdot x$ and $(1-g) \cdot y$, respectively, when the switches 8*a* and 8*b* are in the ON states. And therefore, the output of the adder 2 becomes equal to $$g \cdot x + (1-g) \cdot y \quad (1)$$

On the other hand, in the low-pass filter 28, the output of the subtractor 29 is (x−y), and the output of the multiplier 31 becomes equal to g.(x−y) when the switch 30 is in the ON state. Also, when the switch 30 is held in the ON state, the output of the adder 32 becomes equal to $$g \cdot (x-y) + y = g \cdot x + (1-g) \cdot y \quad (2)$$

Figure 10:
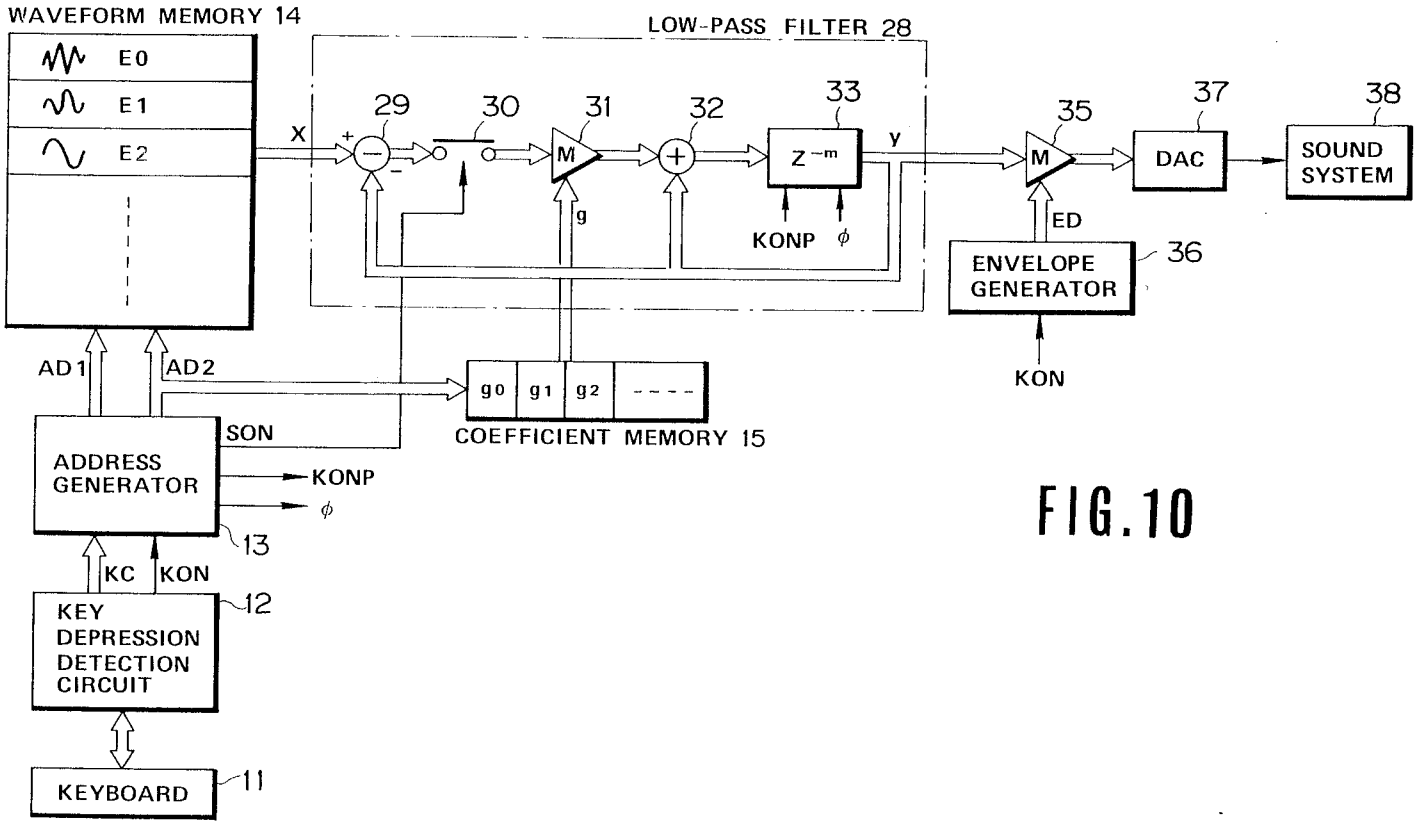
FIG. 10 is a block diagram of a musical tone generating apparatus provided in accordance with the present invention.
Figure 11:
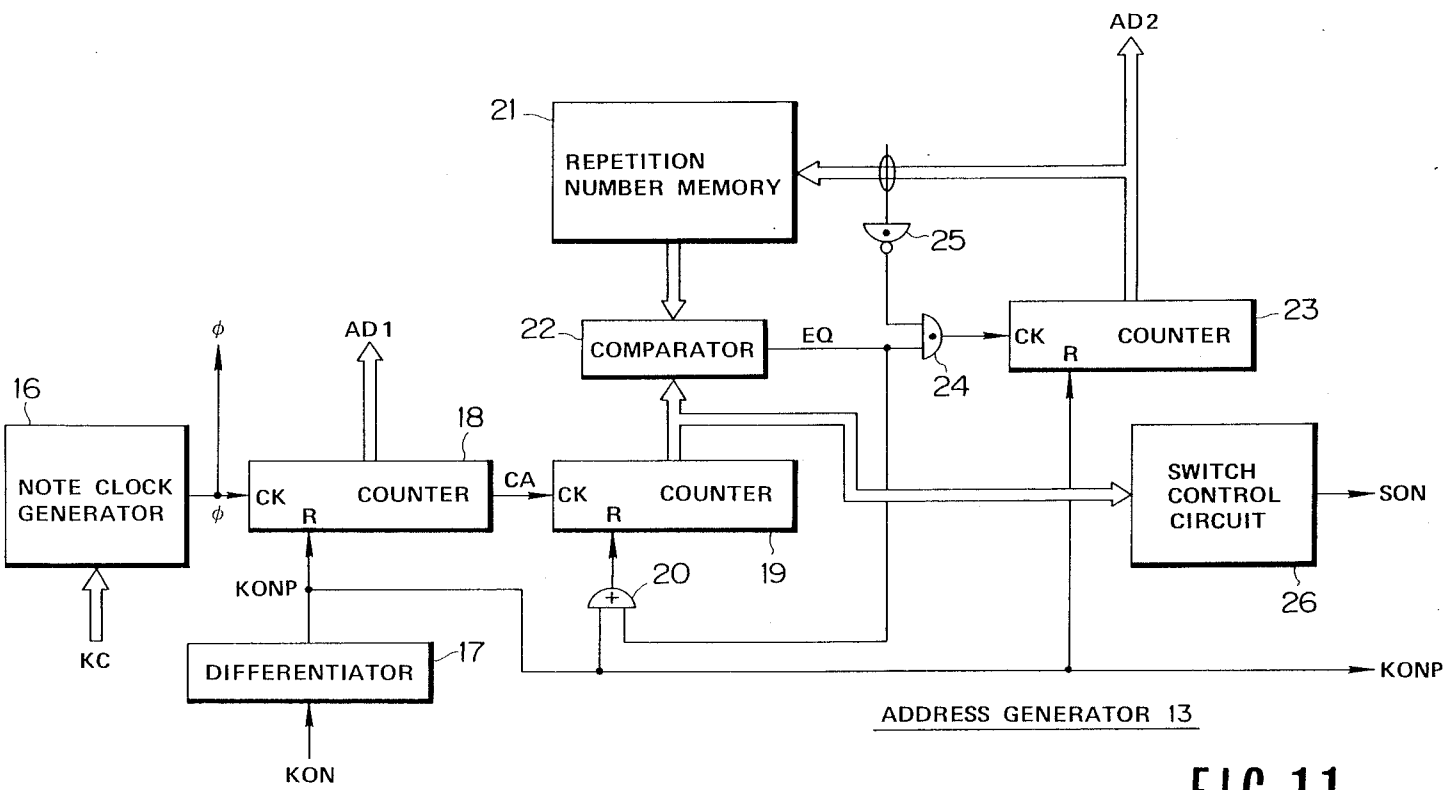
FIG. 11 is a block diagram of the low-pass filter 28 of the musical tone generating apparatus of FIG. 10.

It is apparent from the above formulas (1) and (2) that the low-pass filter 28 shown in FIG. 10 is equivalent to the low-pass filter of FIG. 9. With the low-pass filter 28, the data contained in the delay circuit 33 are self-held when the switch 30 is held in the OFF state, as in the case of the low-pass filter of FIG. 9.

The coefficient memory 15 previously stores filter coefficients $g_0, g_1, \ldots$ to be supplied to the multiplier 31. The coefficients $g_0, g_1, \ldots$ are read from the memory 15 in accordance with the address data AD2 and supplied to the multiplier 31.

A multiplier 35 multiplies output data of the low-pass filter 28 by envelope data ED fed from an envelope generator 36 and supplies data representative of the multiplication results to a digital-to-analog converter (DAC) 37. The DAC 37 converts the data fed from the multiplier 35 into an analog signal and supplies the analog signal to a sound system 38. The sound system amplifies the supplied analog signal and supplies the amplified analog signal to a loudspeaker to thereby produce the musical tone.

The operation of this embodiment will now be described.

When a key on the key board 11 is depressed, the key depression detection circuit 12 detects the depression of the key and outputs to the address generator 13 a key code KC representative of the depressed key together with a key-on signal KON of "1". Thus, the note clock generator 16 (FIG. 11) in the address generator 13 begins to generate a note clock $\phi$ whose frequency corresponds to the depressed key represented by the key code KC. On the other hand, the differentiator 17 outputs a key-on pulse KONP at the leading edge of the key-on signal KON, whereupon the counters 18, 19 and 23 and the DFFs of the delay circuit 33 in the low-pass filter 28 are reset. When the counter 23 is reset, address data AD2 equal to "0" is outputted therefrom to the waveform memory 14 and the coefficient memory 15. Thus, the storage area E0 in the waveform memory 14 is designated, and the filter coefficient $g_0$ is read from the coefficient memory 15 and supplied to the multiplier 31. The address data AD2 of "0" is also supplied to the repetition number memory 21, whereupon data representative of the number of repetitions of the portion A1 (see FIG. 1) is read therefrom and supplied to the comparator 22. It is assumed here that the number of repetition is N1.

After being reset by the key-on pulse KONP, the counter 18 counts up the note clock $\phi$, so that address data AD1, which varies from "0" to "m−1", is repeatedly outputted from the counter 18. The counter 18 also outputs a carry signal CA when the address data AD1 returns from "m−1" to "0". While the address data AD1 varying from "0" to "m−1" is repeatedly outputted, the sample data in the storage area E0 of the waveform memory 14 are sequentially and repeatedly read therefrom and supplied through the low-pass filter 28 to the multiplier 35. The filtered sample data is applied with an envelope at the multiplier 35 and then converted into an analog signal by the DAC 37. The thus obtained analog signal is supplied to the sound system 38 whereby the musical tone corresponding to the time T1 of FIG. 1 is produced.

On the other hand, the counter 19 counts up the carry signals CA outputted from the counter 18. And, when the count output of the counter 19 reaches the aforesaid repetition number N1, the comparator 22 outputs a coincidence signal EQ to the counter 23 through the AND gate 24, whereupon address data AD2 equal to "1" is outputted from the counter 23. When the address data AD2 of "1" is outputted, the storage area E1 of the waveform memory 14 is designated, and at the same time the filter coefficient $g_1$ and the repetition number (assumed to be N2) of the portion A2 of FIG. 1 are read from the coefficient memory 15 and the repetition number memory 21, respectively. On the other hand, the coincidence signal EQ is also supplied to the reset terminal R of the counter 19 to reset the same. Thus, the sample data in the storage area E1 are sequentially and repeatedly read therefrom in accordance with the address data AD1. The sample data thus read from the storage area E1 are subjected to the compensation for the abrupt variation of waveform at the low-pass filter 28. The output data of the low-pass filter 28 are then applied with an envelope at the multiplier 35 and fed through the DAC 37 to the sound system 38, whereby the musical tone corresponding to the time T2 of FIG. 1 is produced.

When the count output of the counter 19 reaches the repetition number N2, the comparator 22 again outputs the coincidence signal EQ whereupon address data equal to "2" is outputted from the counter 23. As a result, the storage area E2 of the waveform memory 14 is designated, and the filter coefficient $g_2$ and the repetition number N3 are read from the coefficient memory 15 and the repetition number memory 21, respectively. The coincidence signal EQ also resets the counter 19, and thus the musical tone corresponding to the time T3 of FIG. 1 begins to be produced.

And thereafter, an operation similar to the abovedescribed operation is repeated. While the above operation is repeated, the switch control circuit 26 repeatedly outputs a switch control signal of "1". As a result, the switch 30 is alternately and repeatedly brought into the ON and OFF states in synchronism with the count output of the counter 19. And, when the address data AD2 outputted from the counter 23 becomes equal to "11 . . . 1", the sample data in the last storage area of the waveform memory 14 are read to produce the corresponding musical tone signal. Also, when the address data AD2 of "11 . . . 1" is outputted, the output signal of the NAND gate 25 is rendered "0" to close the AND gate 24, so that the address data AD2 will not vary any more until a key is newly depressed at the keyboard 11.

With the above embodiment, the waveform data stored in each of the storage areas E0, E1, . . . represent one period or one cycle of the musical tone waveform at the corresponding portion, however waveform data representative of consecutive two or more periods of the musical tone wave at the corresponding portion may alternatively be stored in each storage area of the waveform memory 14. With the above embodiment, the waveform memory 14 is used as means for generating the waveform data (or the sample data), however other means such as one which generates the waveform data based on a predetermined calculation may substitute therefor. Furthermore, with the above embodiment, the delay time of the delay circuit 33 is set to one period of the musical tone waveform, the delay time may however be set to a length which corresponds to a plurality of periods of the waveform. In this case, the delay circuit 33 can be constituted by a shift register, a RAM or the like. Furthermore, with the above embodiment, the output data of the low-pass filter 28 are derived from the output terminal of the delay circuit 33, however, the output data of the filter 28 can be derived from any other appropriate points of the circuit including the output terminal of the adder 32. With the above embodiment, although the envelope of the musical tone is applied to the tone signal with the multiplier 35 and the envelope generator 36, the envelope of the musical tone at a decay portion thereof can be applied to the tone signal with the low-pass filter 28 in the following manner. From the beginning of the decay portion, the output data of the low-pass filter 28 is exponentially decreased by holding the switch 30 in the ON state, rendering the output data from the waveform memory 14 "0" and setting the coefficient g applied to the multiplier 31 to an appropriate value. Thus, the envelope of the decay portion can be applied to the tone signal without the multiplier 35 and the envelope generator 36. Also, although the tone signal is generated by a digital processing in the above embodiment, this invention can be applied to a musical tone generating apparatus in which a tone signal is generated by an analog processing. Furthermore, this invention can be applied not only to an apparatus for generating a musical tone signal corresponding to a depressed key on the keyboard, but also to other apparatuses such as one for generating a musical tone signal corresponding to a tone of a percussive musical instrument.

What is claimed is:

1. A tone signal generating apparatus comprising:

(a) waveform data generating means for generating data relating to at least first and second periodic waveforms of a tone signal, said waveform data generating means sequentially generating data representative of sample points of said first waveform and data representative of sample points of said second waveform; and (b) low-pass filter means for filtering said sample points of said data sequentially generated by said waveform generating means on a time shared basis so as to interpolate the corresponding sample points of the first and second waveforms to output a filtered data as said tone-signal, said low-pass filter means comprising delay circuit means and feedback circuit means, the delay circuit means for delaying data supplied thereto from the waveform data generating means by a time interval determined in accordance with the periods of said first and second waveforms so as to output delayed data, said delay circuit means having a plurality of dalay stages, each stage of which corresponds to a sample point of said first and second waveform; and the feedback circuit means for multiplying said delayed data by a predetermined feedback coefficient and feeding the resultant data back to said delay circuit means as feedback data.

2. A tone signal generating apparatus according to claim 1, wherein the period of said first waveform is identical to that of said second waveform.

3. A tone signal generating apparatus according to claim 2 further comprising a keyboard having a plurality of keys, said waveform data generating means being responsive to a depressed key among said plurality of keys to generate said data at a rate determined by a pitch corresponding to said depressed key.

4. A tone signal generating apparatus according to claim 3, wherein said delay circuit means delays data by one period of said first and second waveforms.

5. A tone signal generating apparatus according to claim 3, wherein said delay circuit means delays data by a plurality of periods of said first and second waveforms.

6. A tone signal generating apparatus according to claim 3, wherein said waveform data generating means comprises first memory means storing the data representative of said first and second waveforms and address generator means responsive to said depressed key for outputting address data to said first memory means so that said data are read from said first memory means at a rate determined by a pitch corresponding to said depressed key.

7. A tone signal generating apparatus according to claim 6 further comprising second memory means for storing data representative of filter coefficients, said address generator means further outputting second address data to said second memory means so that said data representative of filter coefficients are read therefrom in synchronism with the readout of said data representative of said waveforms from said first memory means, said read data representative of filter coefficients being supplied to said low-pass filter means.

8. A tone signal generating apparatus according to claim 7 further comprising control signal generating means for outputting a switch control signal which repeatedly becomes active in accordance with the readout of said data representative of said waveforms from said first memory means, said low-pass filter means further comprising switch circuit means responsive to said switch control signal for preventing said data read from said first memory means from being supplied to said delay circuit means and for feeding said delayed data directly back to said delay circuit means.

9. A tone signal generating apparatus comprising:

waveform data generating means for generating data representative of sample points of sequentially generated first and second waveforms of a tone signal, said waveforms having an equal number of sample points, with each sample point of the second waveform corresponding to a different sample point of the first waveform; and low-pass filter means for sequentially receiving the data representative of each successive sample point of each waveform and filtering the received data with respect to data representative of corresponding sample points of previously generated waveforms, said low-pass filter means thereby operating on a time shared basis so as to interpolate the corresponding sample points of the first and second waveforms to output filtered data as a tone signal.

* * * * *